United States Patent [19]

Santilli

[11] Patent Number: 4,574,169

[45] Date of Patent: Mar. 4, 1986

[54] BIMETALLIC ARC SHIELD

[75] Inventor: Vincent J. Santilli, Corning, N.Y.

[73] Assignee: Westinghouse Electric Corp., Pittsburgh, Pa.

[21] Appl. No.: 647,205

[22] Filed: Sep. 4, 1984

[51] Int. Cl.[4] ..... H01H 33/66

[52] U.S. Cl. ..... 200/114 B

[58] Field of Search ..... 200/144 B

[56] References Cited

U.S. PATENT DOCUMENTS

| | | | |
|---|---|---|---|
| 3,280,286 | 10/1966 | Ranheim | 200/144 B |
| 3,485,978 | 12/1969 | Grindell | 200/144 B |
| 3,913,047 | 10/1975 | Arthur et al. | 200/144 B |
| 3,955,167 | 5/1976 | Kumbera | 200/144 B |
| 4,020,304 | 4/1977 | Cherry | 200/144 B |
| 4,424,427 | 1/1984 | Gebel et al. | 200/144 B |

FOREIGN PATENT DOCUMENTS

| | | | |
|---|---|---|---|
| 0134819 | 3/1979 | Fed. Rep. of Germany | 200/144 B |

*Primary Examiner*—Robert S. Macon

*Attorney, Agent, or Firm*—C. L. Menzemer

[57] ABSTRACT

A vacuum-type circuit interrupter is provided having a bimetallic vapor or condensing shield. The shield has a first surface consisting of a layer of a high electrically conductivity metal, as for example copper which is exposed to or faces the arcing area within the interrupter and a second layer of a superior high voltage material, as for example stainless steel which is affixed to that surface of the layer of copper away from the arcing area. The layer of stainless steel overlaps the layer of copper at the ends of the shield to an extent that allows it to be rolled over or formed to relieve electrical stresses.

2 Claims, 2 Drawing Figures

BIMETALLIC ARC SHIELD

CROSS-REFERENCE TO RELATED APPLICATIONS

Applicant is not aware of any related applications pertinent to the present invention.

BACKGROUND OF THE INVENTION

1. Field of the Invention:

The present invention is in the field of vacuum interrupters generally and is specifically directed to vapor or condensing shields for vacuum interrupters.

2. Description of the Prior Art:

It has been customary in the design of vacuum-type circuit interrupters, to provide a vapor or condensing shield to prevent the outward dissemination of metallic particles during arcing and their concomitant deposit on the inner walls of the outer insulating casing, which may be, for example, of glass or ceramic material. Consequently, practically all vacuum-type circuit interrupters have such condensing shields.

Some of the shields may be disposed at the potential of one of the separable contacts, as in U.S. Pat. Nos. 2,975,256, Lee et al, or 3,244,842, Kameyama et al. Other condensing shields may, for example, be at a floating potential, such as set forth in U.S. Pat. No. 3,592,987, Lempert et al.

U.S. Pat. No. 4,020,304 teaches a vacuum type circuit interrupter having a vapor or condensing shield comprised of two materials.

The central portion of the vapor shield, that portion of the shield exposed to the arc, consists of a high conductivity material, for example copper, and the end portions of the shield are comprised of a high voltage material such as stainless steel, steel, nickel, aluminum and an alloy containing approximately 66%, by weight, nickel and 31%, by weight copper. This alloy is sold commercially under the Trademark Monel.

The central copper portion is brazed to the second metal, for example, stainless steel.

In FIG. 3 of U.S. Pat. No. 4,020,304, a shield is shown in which the stainless steel portion of the shield extends the whole length of the shield and a copper portion is brazed to the steel portion only in the arcing area.

Such a structure as that shown in FIG. 3 of the U.S. Pat. No. 4,020,304 has the shortcoming that a high electrical field and a field emission is established between the contacts of the interrupter and the shield at the point where the copper portion ends.

SUMMARY OF THE INVENTION

The present invention provides a vacuum type circuit interrupter including in combination, means for defining an evacuated envelope, a pair of separable contacts disposed within the evacuated envelope and separable to establish arcing, a vapor condensing arc shield provided interiorly within said evacuated envelope to prevent the deposition of metallic particles emitted from the arcing region onto the means defining the evacuated envelope, said vapor condensing shield being bimetallic and consisting of a first layer of a relatively high electrically conductive metal and a second layer of a relatively high breakdown voltage material, one major surface of said relatively high electrically conductive metal layer facing toward said arcing region or area of said interrupter, said layer of high breakdown voltage material being affixed to a second major surface of said first layer over the entire length of said shield, said second major surface of said first layer being opposed to said one major surface of said first layer.

BRIEF DESCRIPTION OF THE DRAWINGS

For a better understanding of the present invention reference should be had to the following detailed discussion and description and to the drawings of which.

DESCRIPTION OF THE PREFERRED EMBODIMENT

Figure 1:
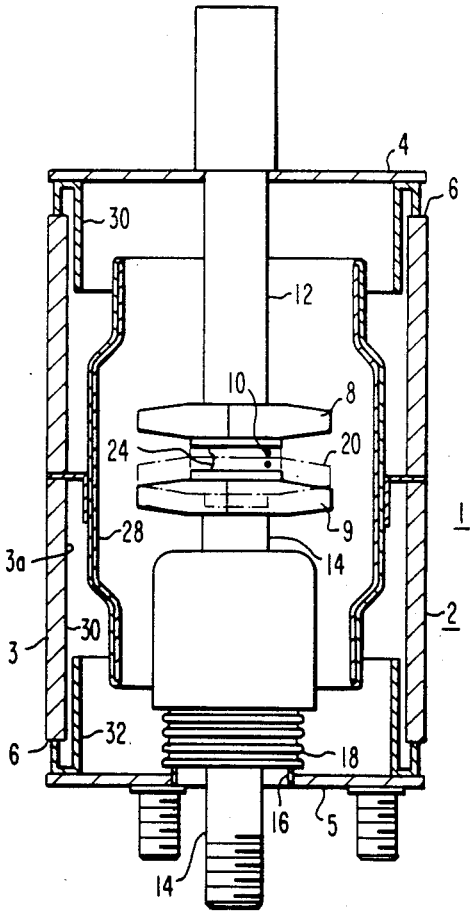
FIG. 1 is a vertical sectional view of a vacuum type interrupter, with the contacts being illustrated in the fully open position, embodying the principles and teachings of the present invention.

Referring to the vacuum-type circuit interrupter of FIG. 1, generally designated by the reference numeral 1, there is shown a highly-evacuated envelope 2 comprising a casing 3 of suitable insulating material, and a pair of metallic end caps 4 and 5, closing off the ends of the casing 2. Suitable seals 6 are provided between the end caps and the casing 2 to render the envelope vacuum-tight. The normal pressure within the envelope 2, under static conditions, is lower than $10^{-4}$ torr; so that reasonable assurance is had that the mean free path for electrons will be longer than the potential breakdown paths within the envelope 2.

Located within the envelope 2 is a pair of relatively movable contacts, or electrodes 8 and 9, shown in full lines in FIG. 1 in their separated or open-circuit position. When the contacts 8 and 9 are separated there is an arcing gap 10 located therebetween. The upper contact 8 is a stationary contact suitably secured to a conductive rod, or stem 12, which at its upper end is united to the upper end cap 4. The lower contact 9 is a movable contact joined to a conductive operating rod, or stem 14, which is suitably mounted for movement. The operating rod 14 projects through an opening 16 in the lower end cap 5, and a flexible metallic bellows 18 provides a seal about the rod, or stem 14, to allow for movement of the rod without impairing the vacuum inside the envelope 2. As shown in FIG. 1, the bellows 18 is secured in sealing relationship at its respective opposite ends to the operating rod 14 and to the lower end cap 5.

Coupled to the lower end of the operating rod 14, suitable actuating means (not shown) are provided for driving the movable contact 9 upwardly into engagement with the stationary contact 8, so as to close the circuit through the interrupter 1. The closed position of the movable contact is indicated by the dotted lines 20. The actuating means is also capable of returning the contact 9 to its illustrated solid-line open position, so as to open the circuit through the interrupter 1. A circuit-opening operation will, for example, entail a typical gap length, when the contacts 8 and 9 are fully separated, of perhaps ½ inch.

The arc, indicated at 24, that is established across the gap 10 between the electrodes 8 and 9, as the electrodes are opened, and also when they are closed, vaporizes some of the contact material, and these vapors are dispersed from the arcing gap 10 toward the envelope 2. In the illustrated interrupter 1, the internal insulating surfaces 3*a* of the casing 3 are protected from the condensation of arc-generated metallic vapor and particles thereon by means of a tubular bimetallic vapor condensing arc shield 28 suitably supported upon the casing 3, and preferably isolated from both end caps 4 and 5. This shield 28 acts to intercept and to condense arc-generated metallic vapors before they can reach the casing 3. To reduce the chances of vapor bypassing the shield 28, a pair of end shields 30 and 32 are provided at opposite ends of the central shield 28.

Figure 2:
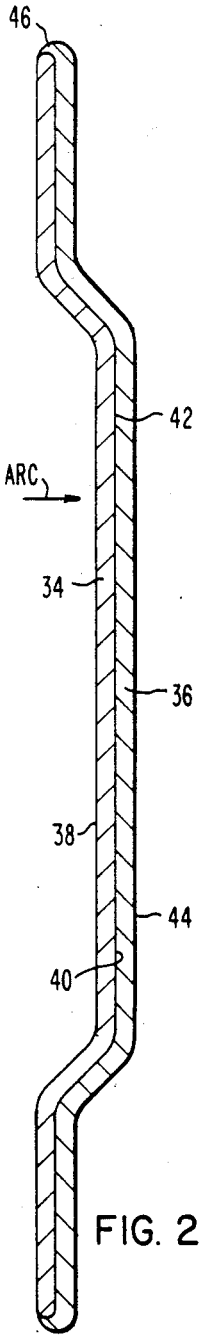
FIG. 2 is a sectional view of a portion of a vapor shield embodying the teachings of the present invention.

With additional reference to FIG. 2, the bimetallic vapor condensing arc shield 28 consists of a first layer 34 of a relatively high electrically conductive metal, for example, copper, and a second layer 36 of a high voltage breakdown material, as for example, stainless steel and steel.

The first layer 34 of, for example, copper, has first and second opposed major surfaces 38 and 40 respectively. The first major surface 36 faces inwardly toward the electrodes 8 and 9 of the interrupter 1 and thus toward the arc indicated at 24.

The second layer 36 has first and second opposed major surfaces 42 and 44 respectively.

First major surface 42 of the second layer 36 is affixed to the second major surface 40 of first layer 34. The second major surface 44 of second layer 36 faces toward the envelope 2.

The second layer 36 consists of stainless steel or steel.

The two layers, 34, of copper and 36, of stainless steel or steel, can be formed by first forming the layer 34 of copper and layer 36 of stainless steel separately.

The copper layer 34 or at least surface 40 thereof is then chemically polished to expose the grain boundaries of the copper. The polishing can be carried out using a solution of silver nitrate and nitric acid as well known to those skilled in the art.

The surface 42 of the stainless steel layer 36 is plated with a metal selected from the group consisting of copper and nickel, the plated layer typically having a thickness of from 0.5 mils to 1.0 mils.

Surface 40 of copper layer 34 is then brought into contact with plated surface 42 of stainless steel layer 36 and the two layers 34 and 36 are pressed together at a pressure of 90 ton/sq.in. to form the bimetallic heat shield.

A second method of combining copper layer 34 with stainless steel layer 36 comprises positioning the two layers together with a copper powder disposed between them and sintering.

Some of the advantages of the present invention are as follows. The copper layer facing the arc over the entire length of the shield prevents any electrical fields being established between the stainless steel component of the shield and the contacts or any steel components within the interrupter envelope. However, while repeated arcing will eventually burn a relatively circular hole in the copper layer, the second layer of stainless steel will not burn through, thus there is always a barrier between the envelope of the interrupter and the arc.

Further, the copper layer facing the arc prevents severe breakdown between stainless steel to stainless steel. Stainless steel has been found to have a higher breakdown voltage than copper, thus raising the level of current interruption without breakdown.

Ends 46 of the vapor shield are origins of high electric field intensity, which may result in arcing in a vacuum.

However, in the present shield, the stainless steel layer 36 covers the copper layer 34 at the end 46 to prevent build-up of any high electric field. Stainless steel has a breakdown voltage of about three times that of copper. Thus the present invention provides a bimetallic condensing shield that meets both the high voltage and high current interrupting requirements of vacuum type circuit interrupters.

I claim as my invention:

1. A vacuum type circuit interrupter including in combination, means for defining an evacuated envelope, a pair of separable contacts disposed within the evacuated envelope and separable to establish arcing, a vapor condensing arc shield provided interiorly within said evacuated envelope to prevent deposition of metallic particles emitted from the arcing region onto the means defining the evacuated envelope, said vapor condensing arc shield being bimetallic and consisting of a first layer of copper and a second layer of a relatively high breakdown voltage material, said material being selected from the group consisting of stainless steel and steel, one major surface of said copper layer facing toward said arcing region of said interrupter, said layer of high breakdown voltage material being affixed to a second major surface of said copper layer over the entire length of said shield, said second major surface of said copper layer being opposed to said one major surface of said copper layer.

2. The vacuum interrupter of claim 1, in which said second layer consists of stainless steel.

* * * * *